US009630446B1

(12) United States Patent
Kobasky

(10) Patent No.: US 9,630,446 B1
(45) Date of Patent: Apr. 25, 2017

(54) PAINT CAN CROWN

(71) Applicant: Donald Kobasky, St. Petersburg, FL (US)

(72) Inventor: Donald Kobasky, St. Petersburg, FL (US)

( * ) Notice: Subject to any disclaimer, the term of this patent is extended or adjusted under 35 U.S.C. 154(b) by 0 days.

(21) Appl. No.: 14/947,151

(22) Filed: Nov. 20, 2015

Related U.S. Application Data

(63) Continuation-in-part of application No. 29/540,413, filed on Sep. 24, 2015, now Pat. No. Des. 771,341.

(60) Provisional application No. 62/204,860, filed on Aug. 13, 2015.

(51) Int. Cl.
*B65D 23/06* (2006.01)
*B44D 3/12* (2006.01)

(52) U.S. Cl.
CPC ..... *B44D 3/128* (2013.01)

(58) Field of Classification Search
CPC ..... B44D 3/128
USPC ..... 215/392, 393
See application file for complete search history.

(56) References Cited

U.S. PATENT DOCUMENTS

| | | | | |
|---|---|---|---|---|
| 3,894,650 | A * | 7/1975 | Crump | B65D 25/20 220/695 |
| 4,312,459 | A * | 1/1982 | Leach | B65D 81/245 220/256.1 |
| 5,725,122 | A | 3/1998 | Murphy | |
| D475,826 | S * | 6/2003 | Mowe | D32/54 |
| 6,983,862 | B2 | 1/2006 | Nottingham | |
| 7,014,078 | B2 | 3/2006 | Walsh | |
| 7,036,693 | B2 | 5/2006 | Walsh | |
| 8,308,341 | B2 | 11/2012 | Garcia | |

* cited by examiner

*Primary Examiner* — Jeffrey Allen
(74) *Attorney, Agent, or Firm* — Edward P. Dutkiewicz

(57) ABSTRACT

A paint can drip crown, comprising a generally ring shaped configuration. The ring shaped configuration has an outer surface, an inner surface, an a top surface, and a bottom surface. The outer surface has a pair of downwardly projecting paint can handle base engagement recesses. The inner surface has a generally planar ring configuration. The top surface having a generally angled planar configuration. The bottom surface has an outer wall and an inner wall with a recess there between. There is a paint brush dragging bar having a generally arcuate configuration coupled to the inner surface of the ring shaped configuration.

7 Claims, 6 Drawing Sheets

FIG. 1
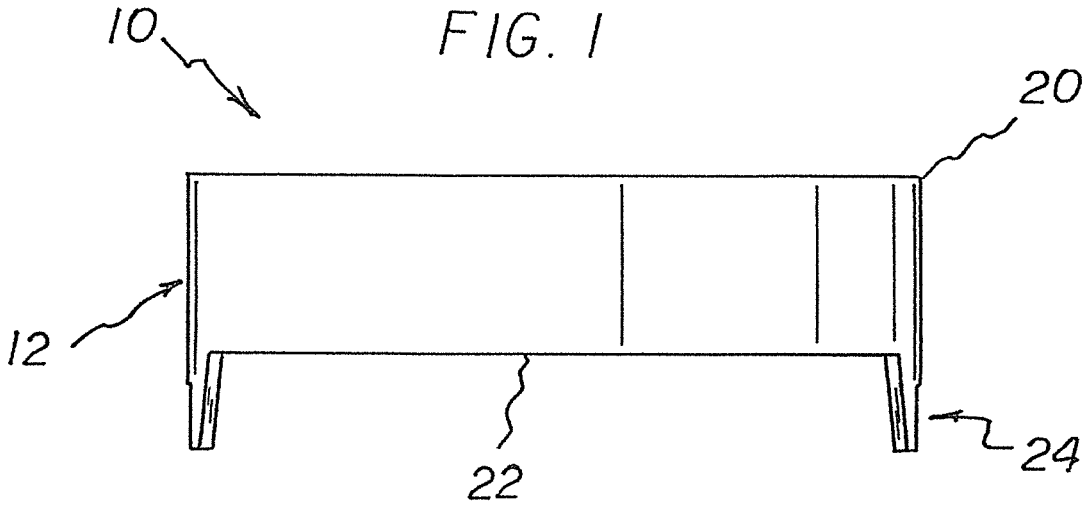
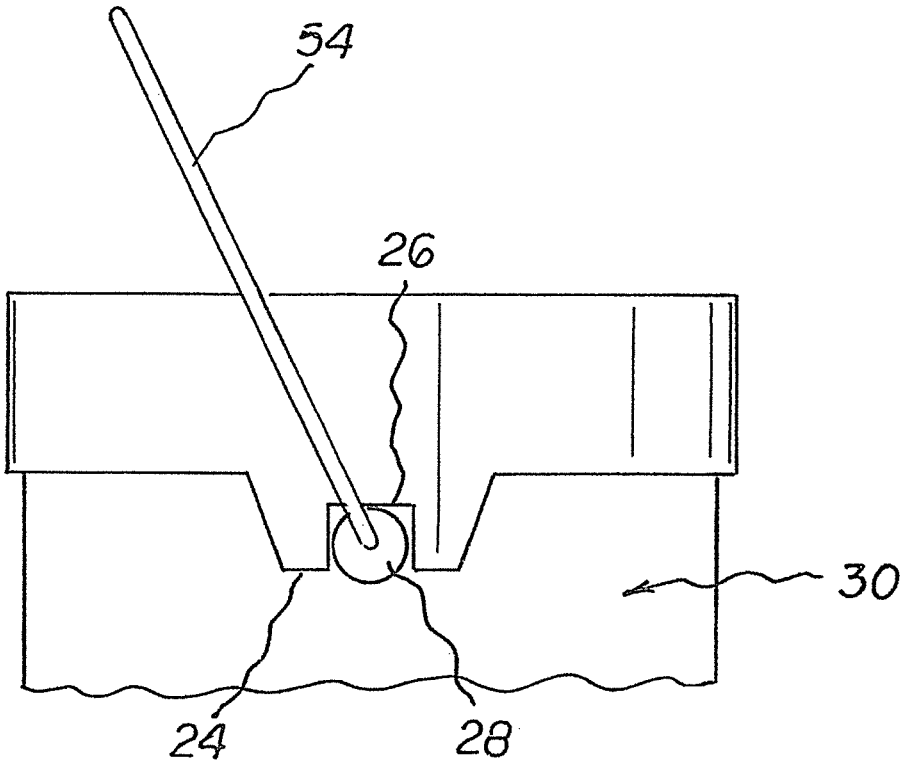
FIG. 2

FIG. 7
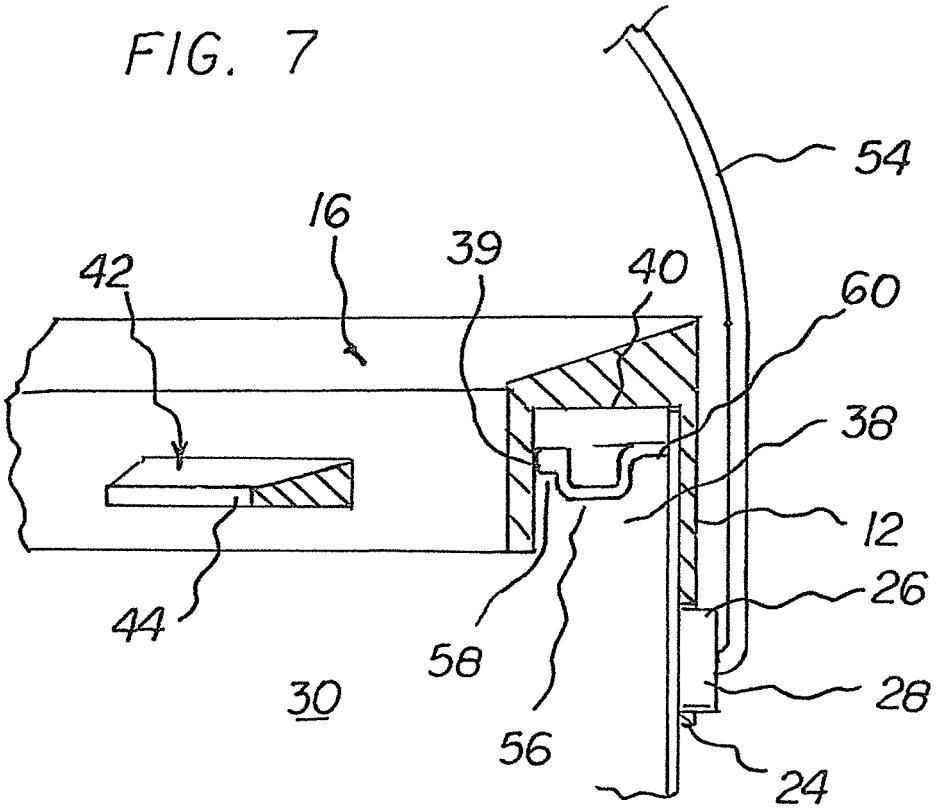
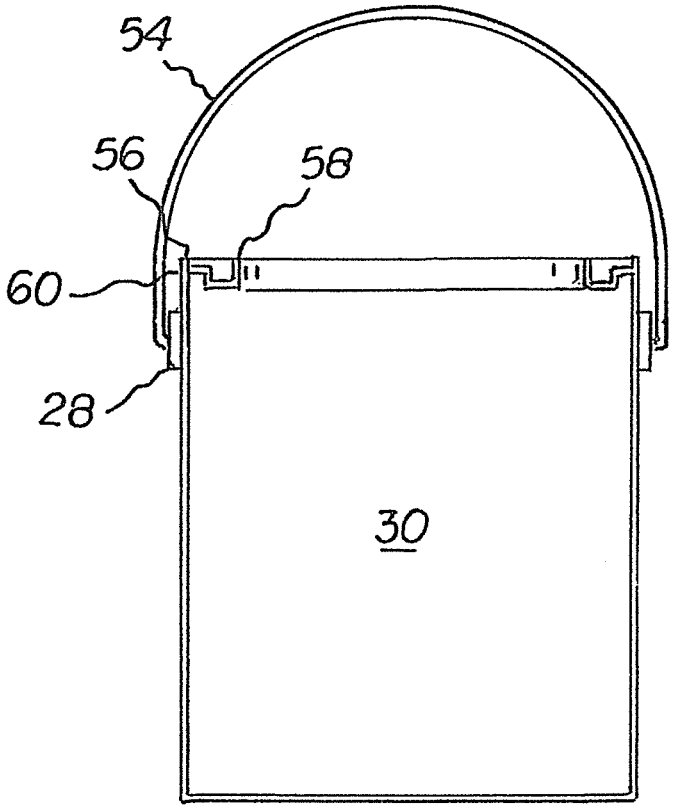
FIG. 8

PAINT CAN CROWN

BACKGROUND OF THE INVENTION

Rule 1.78(F)(1) Disclosure

The Applicant has submitted a related pending or patented non-provisional application within two months of the filing date of this present application. The applicant has submitted a design patent application, bearing Ser. No. 29/540,413, filed on Sep. 24, 2015, and currently pending. The invention is made by a single inventor, so there are no other inventors to be disclosed. This application is not under assignment to any other person or entity at this time.

CLAIM OF PRIORITY

This application is a continuation in part of a presently pending design application bearing Ser. No. 29/540,413, filed on Sep. 24, 2015, and currently pending. This application is also filed as a continuation of the presently provisional patent application, which bears the Ser. No. 62/204,860, and was filed on Aug. 13, 2015. The applicant claims priority of the previously filed design patent application and the provisional patent application.

FIELD OF THE INVENTION

The present invention relates to a PAINT CAN CROWN and more particularly pertains to a device which protects the rim of a paint can from paint.

DESCRIPTION OF THE PRIOR ART

The use of paint can rim protectors is known in the prior art. More specifically, paint can rim protectors previously devised and utilized for the purpose of keeping paint from filling the paint can lip recess are known to consist basically of familiar, expected, and obvious structural configurations, notwithstanding the designs encompassed by the prior art which has been developed for the fulfillment of stated objectives and requirements.

While the prior art devices fulfill their respective, particular objectives and requirements, the prior art does not describe paint can crown that protects the rim of a paint can from paint.

In this respect, the paint can crown, according to the present invention, substantially departs from the conventional concepts and designs of the prior art, and in doing so provides an apparatus primarily developed for the purpose of protecting the rim of a paint can from paint.

Therefore, it can be appreciated that there exists a continuing need for a new and improved paint can crown which can be used to prevent paint from entering the rim of a paint can and preventing adequate resealing of the paint can with a paint can lid. In this regard, the present invention substantially fulfills this need.

SUMMARY OF THE INVENTION

In view of the foregoing disadvantages inherent in the known types of paint can rim protectors now present in the prior art, the present invention provides an improved paint can crown. As such, the general purpose of the present invention, which will be described subsequently in greater detail, is to provide a new and improved paint can crown which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

To attain the objectives, the present invention essentially comprises a paint can drip crown, comprising several components, in combination.

There is a generally ring shaped configuration which is fabricated of a rigid plastic material. The ring has an outer surface, an inner surface, a top surface, and a bottom surface. The outer surface has a flat planar circular configuration with an upper edge and a lower edge.

The outer surface lower edge has a pair of downwardly projecting paint can handle base engagement tabs. Each of the paint can handle base engagement tabs has a rectangular shaped recess therein.

The outer surface has a first external diameter and first radius of curvature. The outer surface has a first height.

The inner surface has a generally planar ring configuration. The inner surface is oriented in a plane generally parallel with the outer surface.

The inner surface has a second height. The second height of the inner surface is less than the first height of the outer surface.

The inner surface has a second internal diameter and a second radius of curvature. The second radius of curvature being less than the first radius of curvature and the second internal diameter being less than the first external diameter.

The inner surface has a center line running across the internal diameter of the inner surface.

The top surface has a generally angled planar configuration. The angled planar configuration is oriented at an angle of between about two hundred and eighty degrees and three hundred and ten degrees, relative to the outer surface. The angulation of the top surface forms an inwardly and downwardly disposed orientation of the top surface.

The top surface has a second width. The top surface is continuous with the inner surface and the outer surface.

The bottom surface has an outer wall and an inner wall, with a recess there between. The recess of the bottom surface has a floor with a generally flat ring configuration.

The bottom surface outer wall has a third width. The bottom surface outer wall is continuous with the outer surface. The bottom surface outer wall has a second internal diameter. The bottom surface inner wall has a fourth width. The bottom surface inner wall is continuous with the inner surface. The bottom surface inner wall has an inner surface with a third internal diameter.

There is a paint brush dragging bar having a generally arcuate configuration. The paint brush dragging bar has a third radius of curvature. The dragging bar has an inner surface, an outer surface, a top surface, and bottom surface.

The dragging bar has a generally curved rectilinear configuration with a third radius of curvature. The third radius of curvature is greater than the first radius of curvature. The paint brush dragging bar is oriented with the inner surface of the paint bar being closer to the center line of the inner surface than is the outer surface of the dragging bar.

The dragging bar has a pair of opposing ends, with each of the ends being fixedly coupled to the inner surface of the ring shaped configuration.

Lastly, there is an existing paint can. The paint can has a pair of handle bases, with each of the handle bases having an associated common handle.

The existing paint can has a top rim. The paint can top rim has an internal lip with an internal diameter and an external diameter. The external diameter of the paint can top rim is less than the internal diameter of the outer wall of the lower surface of the paint can drip crown.

The paint can top rim internal lip internal diameter is sized so that the interal lip of the paint can contactingly slides onto the outer surface of the inner wall of the lower surface of the paint can drip crown.

The paint can handle has a deployed, upright orientation and a stored, generally downward orientation. The handle, in the deployed orientation, contacts the upper edge of the outer surface of the ring configuration through an arc of between about fifteen degrees and sixty degrees.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint can crown which has all of the advantages of the prior art paint can rim protectors and none of the disadvantages.

It is another object of the present invention to provide a new and improved paint can crown which may be easily and efficiently manufactured and marketed.

It is further object of the present invention to provide a new and improved paint can crown which is of durable and reliable constructions.

An even further object of the present invention is to provide a new and improved paint can crown which is susceptible of a low cost of manufacture with regard to both materials and labor, and which accordingly is then susceptible of low prices of sale to the consuming public, thereby making such paint can crown economically available to the buying public.

Even still another object of the present invention is to provide a paint can crown which protects the rim of a paint can from paint.

Lastly, it is an object of the present invention to provide a new and improved paint can drip crown, comprising a generally ring shaped configuration. The ring shaped configuration has an outer surface, an inner surface, an a top surface, and a bottom surface. The outer surface has a pair of downwardly projecting paint can handle base engagement recesses. The inner surface has a generally planar ring configuration. The top surface having a generally angled planar configuration. The bottom surface has an outer wall and an inner wall with a recess there between. There is a paint brush dragging bar having a generally arcuate configuration coupled to the inner surface of the ring shaped configuration.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is front elevation view of the paint can crown.

FIG. 2 is a side elevation view of the paint can crown.

FIG. 7 is a partial cross section view of the device when mounted on a paint can.

FIG. 8 is a cross section view of a paint can.

The same reference numerals refer to the same parts throughout the various Figures.

DESCRIPTION OF THE PREFERRED EMBODIMENT

Figure 3:
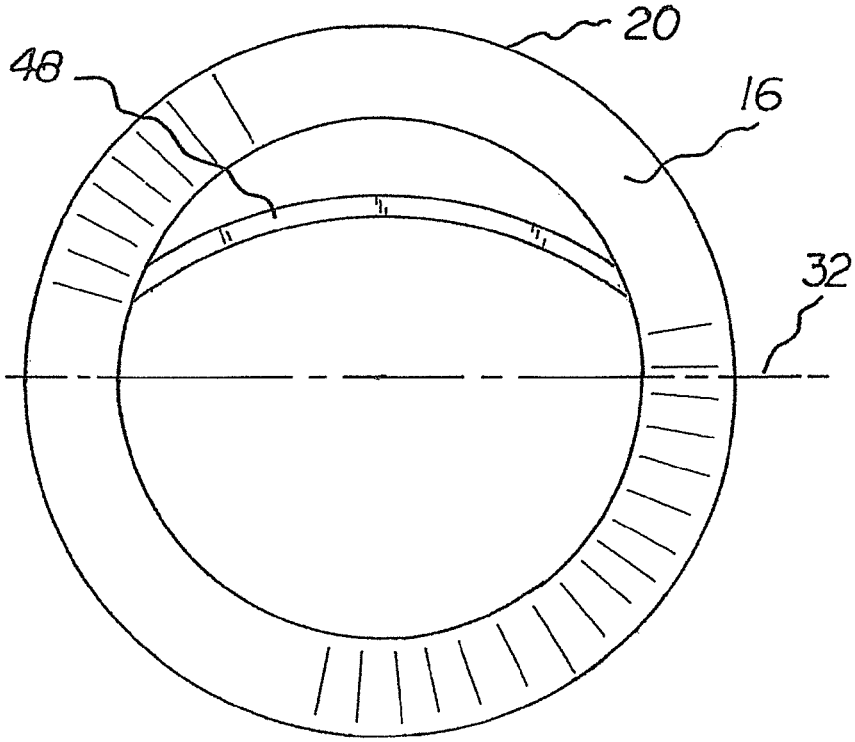
FIG. 3 is a top plan view of the device.
Figure 4:
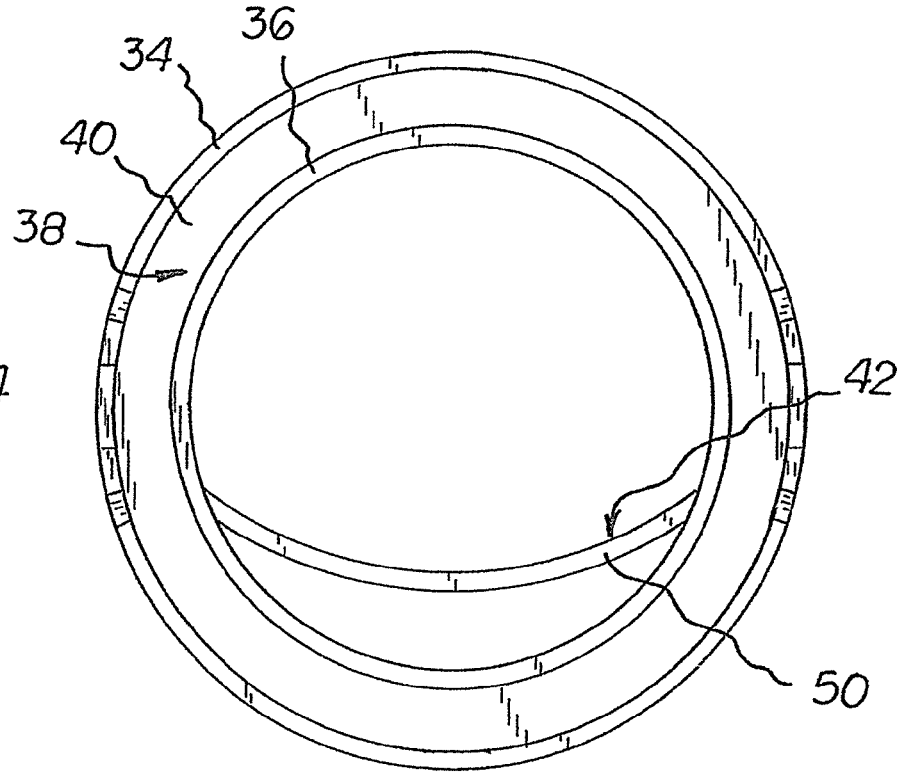
FIG. 4 is a bottom plan view of the device
Figure 5:
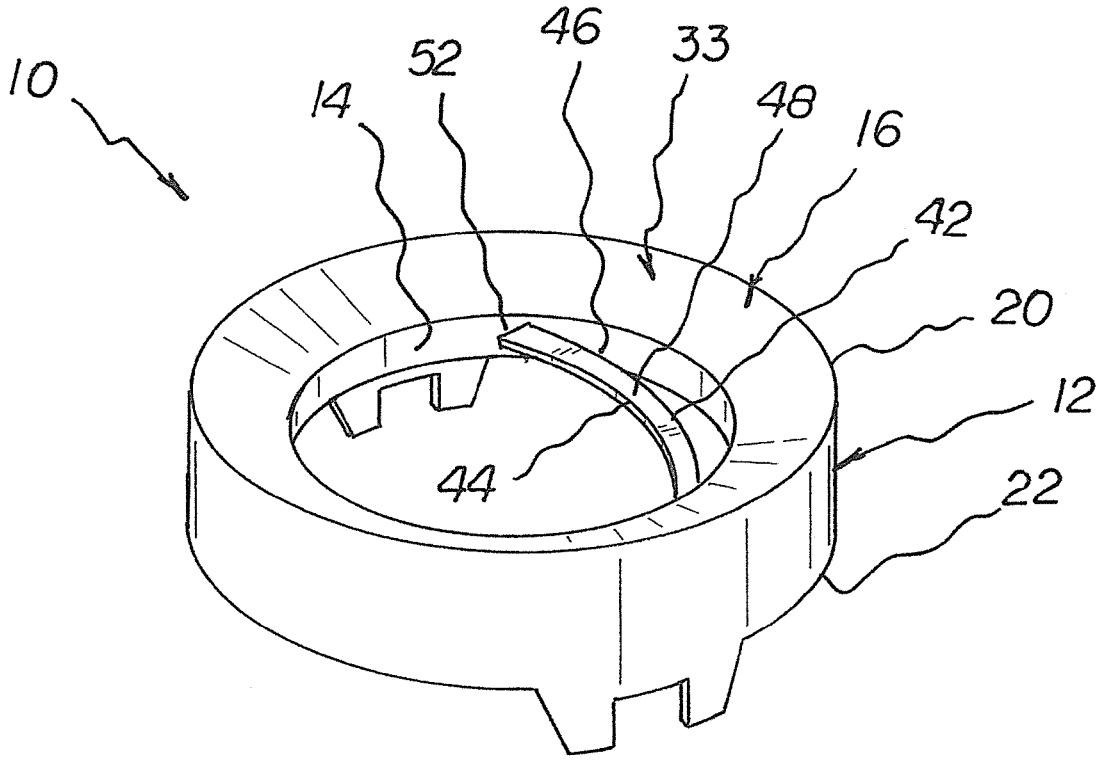
FIG. 5 is a perspective view, taken from a point above and to the side of the device.
Figure 6:
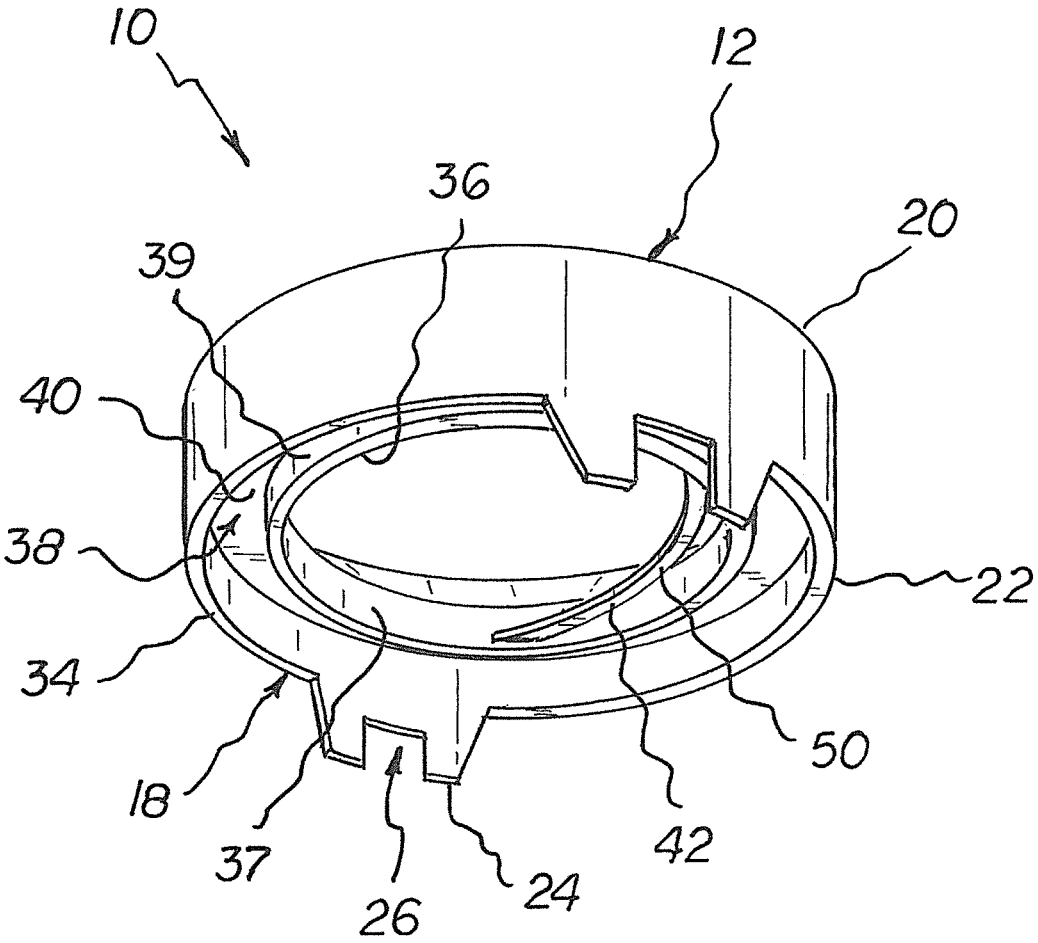
FIG. 6 is perspective view, taken from a point below and to the side of the device.

With reference now to the drawings, and in particular to FIG. 1 thereof, the preferred embodiment of the new and improved paint can crown embodying the principles and concepts of the present invention and generally designated by the reference numeral 10 will be described.

The present invention, the paint can crown 10 is comprised of a plurality of components. Such components in their broadest context include a ring configuration having a bottom inner wall, a bottom recess, an outer upper edge, and a paint brush dragging bar. Such components are individually configured and correlated with respect to each other so as to attain the desired objective.

A paint can drip crown 10, comprising several components, in combination.

There is a generally ring shaped configuration which is fabricated of a rigid plastic material. The ring has an outer surface 12, an inner surface 14, a top surface 16, and a bottom surface 18. The outer surface 12 has a flat planar circular configuration with an upper edge 20 and a lower edge 22.

The outer surface lower edge 22 has a pair of downwardly projecting paint can handle base engagement tabs 24. Each of the paint can handle base engagement tabs 24 has a rectangular shaped recess 26 therein.

The engagement tabs 24 are configured to be received by and mate with the handle bases 28 of an existing paint can 30. The tabs 24 have the rectangular recess 26 so as to accept and engage the handle bases 28, thereby preventing rotation of the ring 10 configuration relative to the paint can 30.

Paint cans 30 have either a round handle base 28 or a square handle base (not shown but well known in the art). The use of the square, or rectangular, recess 26 allows the recess 26 to accept and mate with both square and round handle bases 28 which are found in existing paint cans 30.

The outer surface of the ring configuration has a first external diameter and first radius of curvature. The outer surface has a first height.

The inner surface 14 has a generally planar ring configuration. The inner surface 14 is oriented in a plane generally parallel with the outer surface 12.

The inner surface 14 has a second height. The second height of the inner surface 14 is less than the first height of the outer surface 12.

The inner surface 14 has a second internal diameter and a second radius of curvature. The second radius of curvature being less than the first radius of curvature and the second internal diameter being less than the first external diameter.

The inner surface 14 has a center line 32 running across the internal diameter of the inner surface 14.

The top surface 16 has a generally angled planar configuration 33. The angled planar configuration 33 is oriented at an angle of between about two hundred and eighty degrees and three hundred and ten degrees, relative to the outer surface. The angulation of the top surface 16 forms an inwardly and downwardly disposed orientation of the top surface.

The top surface 16 has a second width. The top surface 16 is continuous with the inner surface 14 and the outer surface 12.

The bottom surface 18 has an outer wall 34 and an inner wall 36, with a recess 38 there between. The recess 38 of the bottom surface 18 has a floor 40 with a generally flat ring configuration.

The bottom surface outer wall 34 has a third width. The bottom surface outer wall 34 is continuous with the outer surface 12. The bottom surface outer wall 34 has a second internal diameter. The bottom surface inner wall 36 has a fourth width. The bottom surface inner wall 36 is continuous with the inner surface 14. The bottom surface inner wall 36 has an inner surface 37 with a third internal diameter and an outer surface 39, with a fourth external diameter.

There is a paint brush dragging bar 42 having a generally arcuate configuration. The paint brush dragging bar has a third radius of curvature. The dragging bar has an inner surface 44, an outer surface 46, a top surface 48, and bottom surface 50.

The dragging bar 42 has a generally curved rectilinear configuration with a third radius of curvature. The third radius of curvature is greater than the first radius of curvature. The paint brush dragging bar 42 is oriented with the inner surface 44 of the paint brush dragging bar being closer to the center line of the inner surface 32 than is the outer surface of the dragging bar 46. The position of the dragging bar 42 provides that a large brush may be dipped into the paint, using the full internal diameter of the ring configuration. The larger arcuate configuration of the dragging bar 42 allows a large brush to be wiped across, or dragged across, the bar 42. The curved ends place more pressure on the ends of the paint brush, and reduce the amount of paint which is on the ends of the brush, and can drip. The dragging bar 42 is angled, relative to the outer surface, so as to allow paint accumulated on the dragging bar, to run off, into the paint can.

The dragging bar 42 has a pair of opposing ends 52, with each of the ends 52 being fixedly coupled to the inner surface 14 of the ring shaped configuration.

Lastly, there is an existing paint can. The paint can has a pair of handle bases, with each of the handle bases having an associated common handle 54.

The existing paint can has a top rim 56. The paint can top rim has an internal lip 58 with an internal diameter and an external extent 60 with an external diameter. The external extent 60 diameter of the paint can top rim is less than the external diameter of the inner wall of the lower surface 39 of the paint can drip crown ring configuration.

The paint can top rim internal lip 58 internal diameter is sized so that the internal lip of the paint can contactingly slides onto the outer surface of the inner wall 39 of the lower surface of the paint can drip crown.

Figure 9:
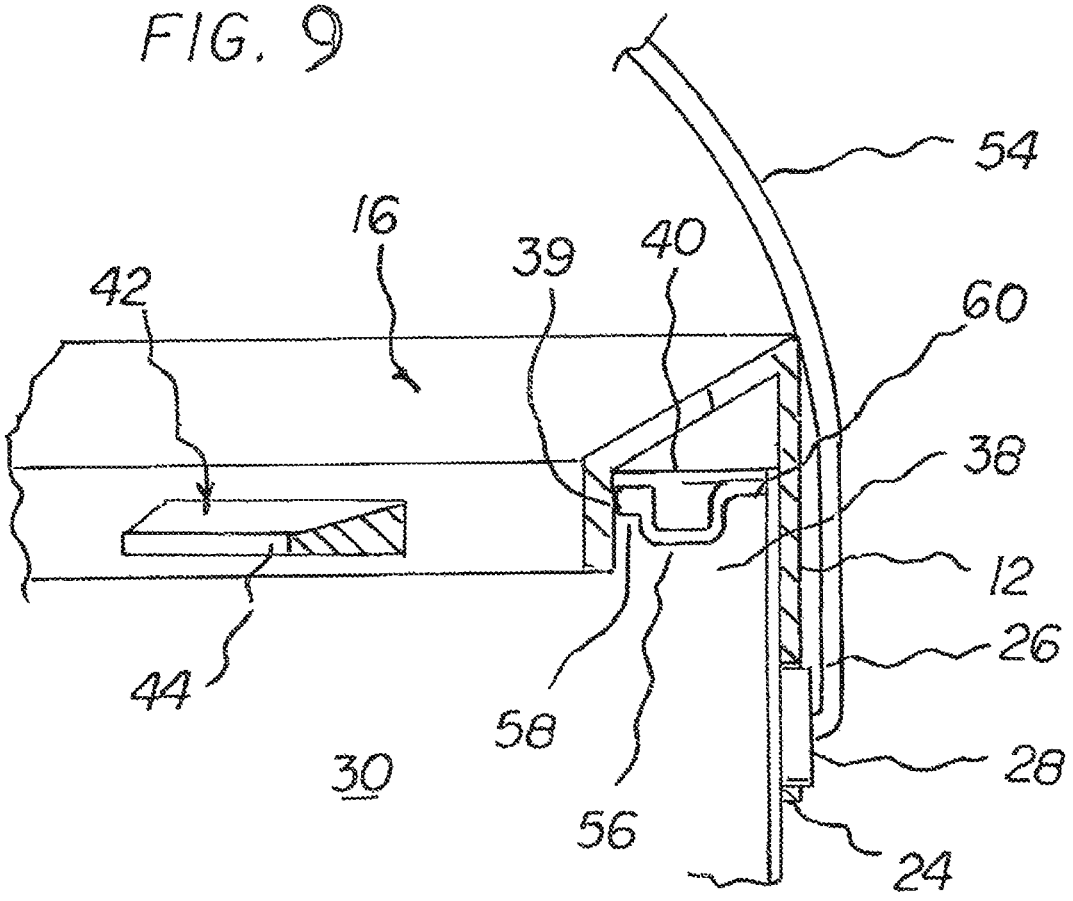
FIG. 9 is a cross section view of a paint can showing the contactingly engagement of the handle and the outer surface of the ring.

By the word contactingly is meant that when the ring configuration is pushed onto the top rim of the paint can, the outer surface of the inner wall 39 contacts the lip 58 of the rim, with friction resulting between the lip 58 and the ring bottom surface inner wall, outer surface 39. The friction is sufficient to prevent free movement of the ring relative to the paint can, and the close proximity, and friction contact between the lip of the paint can 58 and the ring configuration prevents paint from splashing between the lip and the ring configuration. This contactingly closeness allows a user to pour paint from the can while the ring is in place, without leaking paint between the paint can lip and the ring configuration. FIG. 9 shows the close relationship, and what is meant by the term contactingly siding.

The paint can handle has a deployed, upright orientation 62 and a stored, generally downward orientation (not shown, but well known in the art). The handle 54, in the deployed orientation, contacts the upper edge 29 of the outer surface 12 of the ring configuration through an arc of between about fifteen degrees and sixty degrees. This contact is shown in FIG. 9. The contacting of the handle 54 with the outer surface, upper edge of the ring configuration 20 locks the ring configuration to the paint can, and allows the user to carry the paint can by the handle without the risk of the ring configuration falling from the paint can.

The close fit of the inner wall with the lip of the can, and the locking of the ring into place by the upward deployment of the handle, work to prevent any paint from entering the lip structure of the paint can, thereby preventing a proper seal of the paint can by placement of the paint can lid (not shown, but well known in the art).

Lastly, the angled orientation of the upper surface, along with the fit of the ring configuration to the paint can, allows a user to pour paint without the attendant dripping and run-off, which is common with pouring paint from a paint can.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint can drip crown, comprising, in combination:

a generally ring shaped configuration having an outer surface and an inner surface an a top surface and a bottom surface, the outer surface having a lower edge, the outer surface having a pair of downwardly projecting paint can handle base engagement recesses, the outer surface downwardly projecting paint can handle base engagement recesses having a rectangular shape, each recess being located each within a pair of downwardly projecting paint can handle base engagement tabs which are located opposite of each other on the lower edge of the outer surface with the paint can drip crown further comprising the recess of each of the paint can handle base engagement tabs being rectangular shaped, the outer surface of the ring configuration has a first external diameter and first radius of curvature, the outer surface of the ring having a first height, the inner surface having a generally planar ring configuration, the inner surface having a second internal diameter and a second radius of curvature, the second radius of curvature being less than the first radius of curvature, the top surface having a generally angled planar configuration, the angled planar configuration of the top surface angle forming an inwardly and downwardly disposed orientation of the top surface, and the bottom surface having an outer wall and an inner wall with a recess there between, the top surface having a second width, the top surface being continuous with the inner surface and the outer surface, the bottom surface outer wall having a third width and the bottom surface inner wall having a fourth width, the recess of the bottom surface having a floor with a generally flat ring configuration, the bottom surface outer wall having a second internal diameter, the bottom surface inner wall having an inner surface with a third internal diameter; and a paint brush dragging bar having a generally arcuate configuration having a generally curved rectilinear configuration, the dragging bar having a third radius of curvature with the third radius of curvature being greater than the first radius of curvature of the outer surface of the ring, the dragging bar having an inner surface and an outer surface and a top surface and a bottom surface.

2. The paint can drip crown as described in claim 1, with the paint can drip crown further comprising:

the inner surface having a second height with the second height of the inner surface being less than the first height of the outer surface, the inner surface having a second internal diameter, the second internal diameter being less than the first external diameter, the inner surface having a center line running across the internal diameter of the inner surface; and the outer surface having a flat planar circular configuration with an upper edge and a lower edge.

3. The paint can drip crown as described in claim 2, with the paint can drip crown further comprising the top surface having an angled planar configuration being oriented at an angle of between about two hundred and eighty degrees and three hundred and ten degrees relative to the outer surface.

4. The paint can drip crown as described in claim 3, with the paint can drip crown further comprising, the paint brush dragging bar being oriented with the inner surface of the paint bar being closer to the center line of the inner surface than is the outer surface of the dragging bar.

5. The paint can drip crown as described in claim 4 with the paint can drip crown further comprising:

the inner surface being oriented in a plane generally parallel with the outer surface;

the bottom surface outer wall being continuous with the outer surface; and the bottom surface inner wall being continuous with the inner surface.

6. The paint can drip crown as described in claim 5, with the paint can drip crown further comprising the ring shaped configuration and the paint brush drag bar each being fabricated of a rigid plastic material, the drag bar being continuous with the ring shaped configuration.

7. The paint can drip crown as described in claim 6, with the paint can drip crown further comprising:

an existing paint can, the paint can having a pair of handle bases with the handle bases having an associated common handle, the existing paint can having a top rim, with the top rim having an internal lip with an internal diameter and an external diameter, the external diameter of the paint can top rim being less than the internal diameter of the outer wall of the lower surface of the paint can drip crown, the paint can top rim internal lip internal diameter being sized to contactingly be received by and mated with the the outer surface of the inner wall of the lower surface of the paint can drip crown, the paint can handle having a deployed, upright orientation and a stored, generally downward orientation, the handle in the deployed orientation contacting the upper edge of the outer surface through an arc of between about fifteen degrees and sixty degrees.

* * * * *